US006113429A

United States Patent [19]

Weigel et al.

[11] Patent Number: 6,113,429

[45] Date of Patent: Sep. 5, 2000

[54] PLUG-TYPE COUPLING FOR SHEATHED ELECTRICAL CABLES

[75] Inventors: Wilfried Weigel, Werne; Jürgen Tschöpe, Selm; Reiner Frank, Gevelsberg, all of Germany

[73] Assignee: DBT Automation GmbH, Essen, Germany

[21] Appl. No.: 09/020,804

[22] Filed: Feb. 9, 1998

[30] Foreign Application Priority Data

Feb. 25, 1997 [DE] Germany ..... 197 07 402
Oct. 15, 1997 [DE] Germany ..... 197 45 482

[51] Int. Cl.[7] ..... H01R 9/03

[52] U.S. Cl. ..... 439/610; 439/701

[58] Field of Search ..... 439/98, 607–610, 439/578–585, 701

[56] References Cited

U.S. PATENT DOCUMENTS

| | | | |
|---|---|---|---|
| 4,746,305 | 5/1988 | Nomura . | |
| 4,874,335 | 10/1989 | Kussel et al. | 439/589 |
| 4,985,002 | 1/1991 | Maisch et al. | 439/607 |
| 5,083,943 | 1/1992 | Tarrant | 439/583 |
| 5,297,339 | 3/1994 | Morgenstern et al. . | |
| 5,499,934 | 3/1996 | Jacobson et al. . | |
| 5,501,616 | 3/1996 | Holliday . | |
| 5,707,253 | 1/1998 | Matsumoto et al. | 439/610 |
| 5,833,495 | 11/1998 | Ito | 439/610 |

FOREIGN PATENT DOCUMENTS

| | | |
|---|---|---|
| 81 35 428 | 4/1982 | Germany . |
| 84 35 743 | 3/1985 | Germany . |
| 3012292 | 11/1989 | Germany . |
| 3721304 | 12/1992 | Germany . |
| 1038360 | 8/1966 | United Kingdom . |

*Primary Examiner*—Khiem Nguyen
*Attorney, Agent, or Firm*—Bauer & Schaffer, LLP

[57] ABSTRACT

The invention relates to a plug-type coupling for sheathed electrical cables, particularly for use in mining, with a flexible protective sheath which accommodates electrical conductors of the cable. The end of the sheath is gripped in a pullproof and sealed fashion between a pressed sleeve which surrounds it and an inner backing sleeve, these parts forming part of the coupling which also includes a coupling sleeve which adjoins the pressed sleeve and receives an insert which holds contact elements electrically connected to the electrical conductors. According to the invention, the pressed sleeve is joined to the coupling sleeve to form a one-piece connector to which the insert carrying the contact elements can be coupled in a pullproof fashion by means of a snap connection. The distinctive features of the sheathed cable coupling according to the invention are simplicity of construction, ease of assembly and low production cost.

20 Claims, 2 Drawing Sheets

PLUG-TYPE COUPLING FOR SHEATHED ELECTRICAL CABLES

FIELD OF THE INVENTION

The invention relates to a plug-type coupling for sheathed electrical cables of the type stated in the introductory part of claim 1.

The coupling of the invention is particularly, although not necessarily exclusively, useful as a sheathed cable coupling for use in mining environments, primarily in conjunction with underground electrical or electrohydraulic controls, such as, in particular, electrohydraulic shaft lining controls in extraction operations, and also for transmission of electrical control and sensor signals.

BACKGROUND OF THE INVENTION

In the weak current cables widely used in the above mentioned applications, the electrical cables, or the insulation-covered electrical conductors, are usually arranged in a flexible protective sheath, for which a steel-armoured or fabric-filled plastic sheath is generally employed. The fittings which give the cable coupling mechanical strength under tensile load and which make the electrical connection between the conductors are joined to the end of the protective sheath.

Many designs of sheathed cable couplings of the above-mentioned kind are known and have been used in mining for many years (DE 3012292 A1, DE 3721304 C2, DE 8135428.2 U1, DE 8435743.6 U1). In these sheathed cable couplings, the mechanical coupling of the sheathed cables with the mating connectors is usually effected by means of U-shaped plug yokes inserted in grooves in the connectors. Sheathed cable couplings which have proved in practice to be especially effective are those in which the electrical conductors led out of the end of the protective sheath into the coupling boxes or sleeves are embedded in a sealing compound consisting of e.g. synthetic resin, and are connected by their bared free ends protruding from the sealing compound to the electrical contact elements consisting of metal contact pins and/or contact sockets arranged on a contact support made of plastic material which is fitted into the coupling sleeve as an insert and secured therein.

Sheathed electrical cable couplings which are known and commonly used have separate components for the mechanical connection of their coupling halves to the protective sheath and for the mechanical and electrical connection to the mating coupling halves. Consequently, being made of many parts, they are relatively complex and expensive to produce, and in many cases also to assemble.

SUMMARY OF THE INVENTION

Taking as its starting-point a sheathed cable coupling of the kind stated, the invention has as its primary object the provision of an improved sheathed cable coupling which while being of a design suitable for use in mining is less complex and expensive to produce and/or to assemble and can be manufactured more cheaply as a mass-produced item.

A further object of the invention is to provide an improved coupling combining the pressed sleeve with the coupling sleeve as a one-piece connector and in which the insert is axially locked by means of a snap-in connection to the part of the connector forming the coupling sleeve.

According to the invention, the sheathed cable coupling formed as an electrical plug-type coupling uses a sleeve-form connector which comprises in a single part i.e. in a one-piece combination, on the one hand, the pressed sleeve providing the connection to the protective sheath, and, on the other hand, the coupling sleeve providing mechanically pullproof cable connection to a mating connector, preferably by means of the plug yokes commonly used, and forms the holder for the insert which carries the electrical contact elements (eg. contact pins and/or contact sockets), and which is releasably connectable to the connector by means of a simple plug-in or snap-in connection, that is to say preferably without threaded or screwed connections or the like.

The portion of the length of the one-piece connector (which can be produced cheaply as a turned metal part) which forms the pressed sleeve affords, by virtue of its radial compression on the flexible sheath acting in conjunction with the internal backing sleeve, a mechanical compression joint with the sheath which may reliably absorb the axial tensile forces acting on the cable, while providing a reliable watertight joint with the sheath, so that no additional seals, such as seal rings which have to be inserted in grooves, are required.

To ensure that when the compression joint is made the radial compression forces are confined to that portion of the length of the connector which surrounds the sheath-end as the pressed sleeve, and that the portion of the length of the connector which receives the adjoining insert is not unduly deformed by the compression of the end, it is advisable to provide the one-piece metal connector formed by the pressed sleeve and the coupling sleeve, in the region of the gripped end of the sheath, with an annular compression groove appropriately located on the outer circumference of the connector, the metal connector preferably having a smaller wall thickness in the portion of its length forming the pressed sleeve than in the portion of its length forming the coupling sleeve.

For the insert which is connectable to the connector and which forms the support for the electrical contact elements, a component made of plastic material is conveniently used. The metal contact elements can then be embedded in this component with positional accuracy. Also, such a component is cheap to produce. Because a snap-in type connection is provided, no threaded or screwed parts or the like are needed for the connection of the insert. The co-operating latching elements can be formed in situ on, and/or joined to, the insert and the connector without significant cost at the production stage. The snap-in connection between connector and insert can be located inside the sleeve-form connector. A preferable configuration, however, is one in which the insert is externally snap-connected to the connector by means of a coupling collar or similar which clasps the free end of the connector. In this case the connector may have an annular groove on its outer circumference, and the interior of the coupling collar may carry a more or less rib-like latching projection or similar. In order to obtain sufficient radial stretching of the ring-shaped snap collar for the snap connection to be made, the collar may be provided with axial slits staggered in the circumferential direction so that the ring-shaped snap collar consists of individual arcuate segments which can be elastically splayed in the radial direction to make the snap connection. As already stated, the insert with the parts providing the snap connection is conveniently formed as a single plastic moulding in which the electrical contact elements have been embedded.

However, instead of the abovementioned latching projection moulded integrally with the coupling collar, other forms of snap connection may be provided. Advantageous among these are those using mountings and/or inserts made of metal, especially stainless steel, for the latching projections, and preferably those in the form of small snap balls, although snap pins or the like may also be used. Advantageously it is possible to arrange matters so that the metal snap elements are held with a press fit in recesses in the plastic insert, the recesses conveniently consisting of radial insertion holes which pass through the coupling collar and into which the metal snap elements are inserted from outside, causing the said insertion holes to widen so that the snap elements are jammed in them and latch at their inner ends in the recesses (or groove substituting for these) on the connector. Preferably several latching projections in the form of snap balls or snap pins or the like are provided, distributed around the circumference of the insert, or of its coupling collar as the case may be.

In a further advantageous configuration of the invention, the electrical conductors led from the sheath into the connector are embedded in a stopper of sealing compound which is axially supported inside the connector at the back (i.e. on the side of the stopper facing towards the sheath). This has the effect of both providing axial support for the insert when it is in place and securing its contact elements against tensile loading. Particularly advantageous here is an arrangement in which the backing sleeve is provided with a support collar or similar which overlaps the end of the sheath and which supports the back of the stopper of sealing compound, preferably by means of a locating conical face on the stopper which is supported against a corresponding annular conical face on the support collar. The locating cone provides additional security of the electrical conductors against axial tensile load. The stopper is preferably made of a hard sealing compound, e.g. a synthetic resin compound. It is possible to hold the electrical conductors together within the stopper by a cable tie surrounding the conductors, and consisting of a simple plastic clip or the like, the conductors being spread apart within the stopper after emerging from the cable tie towards the insert.

The abovementioned stopper of sealing compound is advantageously connected to the insert carrying the electrical contact elements. The stopper can also be made outside the sleeve-form connector, after which the conductors embedded in it are brought into electrical connection with the insert (the latter being removed from the connector) and the insert is placed in the connector after it has been joined to the stopper.

The insert, which may be made of plastic material, preferably consists of a stopper part which fits inside the cylindrical bore of the connector and in which the electrical contact elements are embedded with positional accuracy, and which is integrally joined to a sleeve-form extension projecting from the sleeve-form connector. This extension accommodates the exposed contact elements, and the annular snap collar may be formed on it. It is advisable to seal the end of the connector at which the insert is inserted against ingress of water and dirt. The stopper part of the insert which engages in the sleeve-form connector can be sealed with an O-ring advantageously fitted in an annular groove in the connector. However, it will usually be better to provide a sealing arrangement in which an end face sealing ring is arranged between the tip of the coupling sleeve and the bottom of the annular groove formed by the snap collar, so that sealing is effective right from the mouth of the connector.

In the sheathed cable coupling according to the invention, the backing sleeve inserted in the coupling end of the flexible protective sheath may consist of a simple plastic injection moulding, or may be in the form of a metal sleeve. It is advisable to provide the portion of the length of the connector forming the pressed sleeve with radial projections (e.g. serrations) directed towards the sheath, while the backing sleeve is provided on its outer circumference with indentations or the like to provide a sound and tight compression joint between the sheath and the connector.

Further advantageous features of the sheathed cable coupling according to the invention are set forth in the dependent claims and will become apparent from the following description of embodiments of the invention illustrated, by way of example, in the drawings.

DETAILED DESCRIPTION OF THE EMBODIMENTS

For a better understanding of the invention, reference is made to the publications previously cited as state of the art, whose disclosure is incorporated by reference in the present description.

Figure 1:
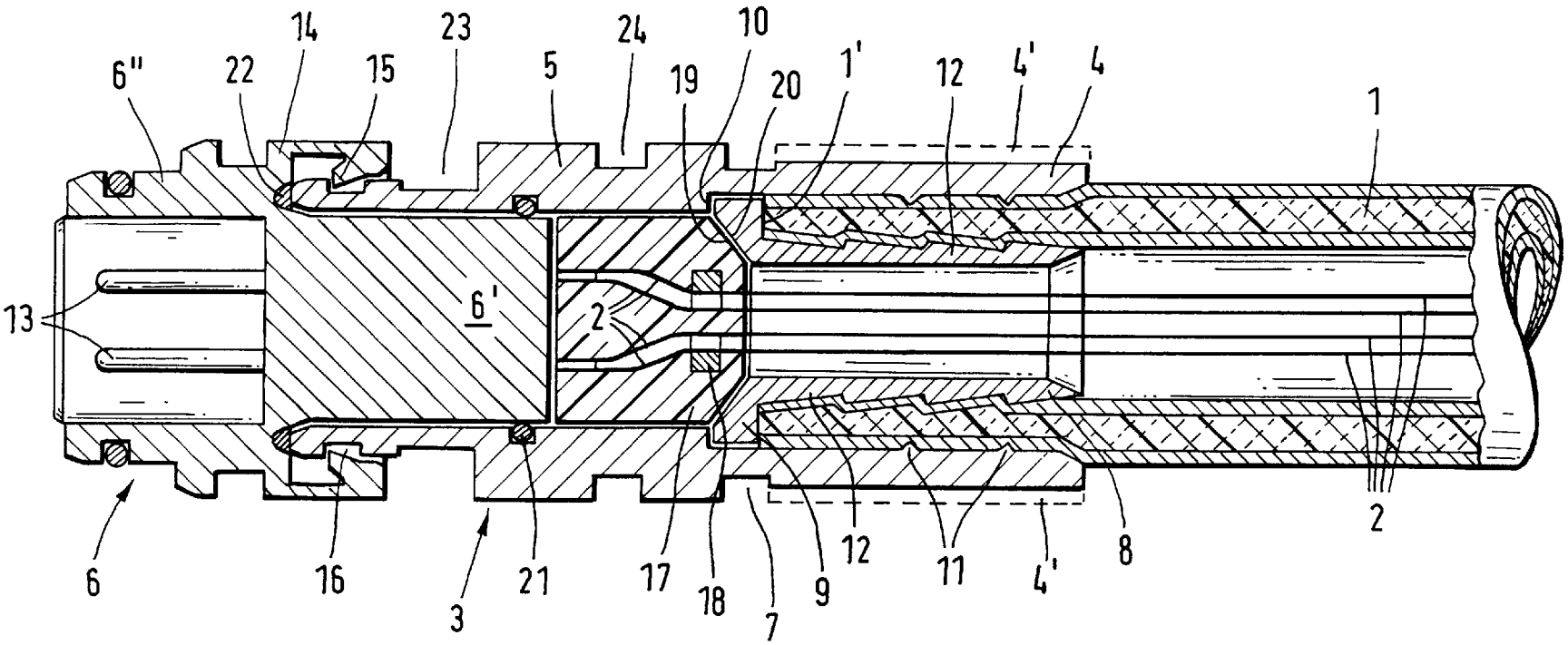
FIG. 1 shows a plug-type coupling according to the invention in axial section (the mating connector for the male plug illustrated in the figure is not shown)

Referring to FIG. 1, the drawing shows, in longitudinal section, one end of a flexible protective sheath 1, which advantageously consists of a flexible tube of plastic material which may, as in the illustration, be provided with a fabric filling, or with steel armour embedded in the plastic material. The function of the sheath 1 is to contain the electrical conductors 2 of the sheathed cable. The individual conductors 2, each covered with insulation, may also be twisted together, and are advantageously accommodated in the sheath 1 with an excess length to allow for possible elongation. Alternatively, a multiwire electric cable, again advantageously with an elongation allowance, may be accommodated in the sheath 1.

A sleeve-form connector 3 consisting of a turned metal part, forming, in a single piece, a pressed sleeve 4 surrounding the sheath end and a coupling sleeve 5 surmounting the inserted sheath end, which serves as holder and connection for an insert 6, is connected by a pullproof and watertight joint to the end of the flexible sheath 1. The portion of the length of the one-piece connector 3 which forms the pressed sleeve 4 extends over the depth of insertion of the sheath 1 into the connector 3, terminating at an external annular circumferential compression groove 7 thereon, at which point the connector 3 has a reduced wall thickness all round. Inserted into the connection end of the sheath 1 is a backing sleeve 8 which extends over the portion of the length of the connector 3 forming the pressed sleeve 4 and carries at its end lying in front of the end 1' of the sheath 1 a reinforced flange or ring collar 9 which is able to rest, in the region of the compression groove 7, against an annular shoulder face 10 of the connector. To make the pullproof and watertight joint, the connector 3 is radially deformed by compression applied to the portion of its length forming the pressed sleeve 4 (and corresponding to the depth of engagement of the sheath 1 into the sleeve-form connector), such compression being in itself a known process. Through this compression the sheath 1 is firmly gripped between the internal backing sleeve 8 and the portion of the length of the connector which surrounds it, i.e. the pressed sleeve 4. The original outer contour of the portion of the length of the connector 3 forming the pressed sleeve 4 prior to compression is indicated in FIG. 1 at 4'. Upon radial compression the flexible sheath is radially deformed and is tightly gripped between the backing sleeve 8 and the pressed sleeve 4, but, owing to the presence of the compression groove 7 in the region of the end of the inserted sheath 1, the deformation forces cannot be transmitted to the surmounting portion of the length of the connector 3 forming the coupling sleeve 5, as here the wall thickness of the sleeve-form connector is significantly greater than in the region of the compression groove 7, hence the portion of the length of the connector 3 forming the coupling sleeve 5 has sufficiently high resistance to deformation to make it impossible for the compression forces to be transmitted to it.

It will be seen that the portion of the length of the connector 3 forming the pressed sleeve 4 and terminating at the compression groove 7 has radial, more or less serrated, projections 11 extending continuously or in arcs around its inner circumference and staggered in the axial direction. When radial compression takes place, these projections 11 penetrate into the flexible material of the cylindrical sheath 1, strengthening the compression joint between the sheath 1 and the connector 3 and at the same time enhancing the seal of the connector 3 in the region of the compression joint against ingress of water from outside. The same applies in relation to the configuration of the backing sleeve 8, which is provided with more or less serrated indentations 12 in its outer circumferential face, into which the material of the sheath 1 is forced by elastic deformation when compression occurs, thus further strengthening the press fit and enhancing the seal.

The backing sleeve 8 inserted in the coupling end of the sheath 1 may consist of a one-piece plastic sleeve made of solid plastic material, or alternatively it may be a one-piece metal sleeve. Rotational orientation of the backing sleeve 8 in relation to the sheath 1 is not necessary. All that matters is that, before the sheath 1 is joined to the connector 3, the backing sleeve 8 is inserted into the sheath 1 as far as the stop at the ring collar 9. The thickened ring collar 9 forms, in the region of the compression groove 7, a backing ring supporting the coupling sleeve internally against the deformation forces.

The insert 6, which can be releasably connected to the sleeve-form connector 3 at the opposite end to that at which the sheath 1 is connected, preferably consists of a plastic moulding in which the metal electrical contact elements are embedded with positional and coupling accuracy, the said contact elements consisting, in a known manner, of either contact pins or contact sockets, and usually of a combination of axial contact pins and axial contact sockets.

The insert 6 has a cylindrical stopper part 6' with a diameter only slightly smaller than the internal diameter of the connector 3 in the region of the portion of its length forming the coupling sleeve 5, this stopper part 6' having the contact elements 13 embedded in it. Integrally joined to the stopper part 6' is a sleeve-form extension 6' projecting from the connector 3 when the insert is in the connected position. The extension 6' accommodates the contact elements 13 projecting axially from the stopper part 6', and carries on its exterior in the region of the transition to the stopper part 6', a ring-shaped snap collar 14, preferably integral with it, which, in the embodiment shown in FIG. 1, is internally provided with an annular latching projection 15. This latching projection 15 co-operates with an annular groove 16 on the outer circumference of the portion of the length of the connector 3 forming the coupling sleeve 5, and this groove 16 forms with the latching projection 5 a snap connection whereby the insert 6 is secured against detachment from the connector 3.

It can be seen that when the insert 6 is connected to the connector 3 the latching projection 15 on the inside of the snap collar 14 slips over a sloping face on the outer rim of the tip of the connector, causing the snap collar 14 (or the latching projection 15 only) to splay elastically so that ultimately the latching projection 15 snaps elastically into the groove 16 when the cylindrical stopper part 6' of the insert 6 is fully inserted into the internal opening in the connector 3 and reaches a predetermined fitted position. To assist the radial elastic splaying of the ring-shaped snap collar 14 when the insert 6 is mounted on the free end of the coupling sleeve 5, the snap collar 14 can be provided with a plurality of axial slits distributed around its circumference. In the illustrated embodiment the elastic latching projection 15 is formed on the snap collar 14 so that it slopes at an oblique angle against the direction of insertion of the insert 6.

As the drawing shows, the conductors 2 are led out of the sheath 1 inside the connector 3 behind the compression zone, i.e. behind the compression groove 7, and are embedded in a cylindrical stopper 17 of sealing compound, preferably a hard sealing compound. Within the body of the stopper 17 the conductors 2 may be bunched together by a cable tie 18 which surrounds them (FIG. 1). The cable tie 18 is embedded in the stopper, and may take the form of e.g. a simple plastic clip or the like. After the cable tie 18 (that is towards the insert 6) the individual conductors 2 in the stopper 17 are led out to their connection positions to the various contact elements 13. The bared free ends of the conductors 2 projecting from the stopper 17 are connected to the contact elements 13 embedded in the insert 6 to establish electrical connection.

The stopper 17 is, as shown, supported at the rear on the ring collar 9 of the backing sleeve 8. Here the stopper has, as shown in FIG. 1, a locating cone 19 formed in situ which rests against a corresponding annular conical surface 20 on the ring collar 9. This resting of the stopper 17 locates the stopper together with the conductors embedded in it within the connector 3, and at the same time the conductors connected to the contact elements 13 are secured against tensile load.

With the arrangement described above, the stopper 17 advantageously forms a part which is permanently connected to the stopper part 6' of the insert 6, so that the conductors 2 are also mechanically connected to the insert 6 via the stopper 17. The stopper 17 of sealing compound can be formed outside the connector 3 in a suitable mould. In this case the ends of the conductors 2, stripped of their insulation, are first of all electrically connected to the contact elements 13 embedded in the insert 6, which at this stage is separate from the connector 3. The stopper 17 is then formed onto the stopper part 6' of the insert 6 in the mould, by introducing a hardenable sealing compound into the mould. After removal from the mould the stopper 17 forms a single assembly unit with the insert 6, and this can be inserted into the connector 3 joined to the sheath 1 by the compression joint, with the locating cone 19 on the stopper 17 arriving in the support position when the snap connection is made between the insert 6 and the connector 3. By adopting this procedure the bunch of conductors 2 is pushed back into the illustrated position upon insertion of the insert 6, and of the stopper 17 joined to it, into the connector 3. The procedure is facilitated by the elongation allowance of the conductors 2 in the sheath 1.

If required, however, the stopper 17 of sealing compound can also be formed with the insert 6 fitted to the connector 3, by filling the internal space in the sleeve-form connector, that is to say the space between the stopper part 6' and the ring collar 9 of the backing sleeve 8, with the hardenable sealing compound, such as e.g. synthetic resin.

A seal is provided to seal the portion of the length of the connector 3 which forms the coupling sleeve 5 against ingress of water and dirt at the connection end of the insert 6. This can take the form of an O-ring inserted in an annular groove in the sleeve-form connector 3, to seal the circumference of the stopper part 6' in the inner opening of the portion of the length of the connector forming the coupling sleeve 5. Preferably, however, a seal is provided at the tip or mounting end of the connector 3 by means of a sealing ring 22 which is inserted e.g. in the annular groove on the insert 6 formed by the snap collar 14, and which is trapped with sealing pressure between the faces of the bottom of the groove and the tip of the connector 3 when the insert 6 is in the connected position.

On the portion of the length of the metal connector 3 which forms the coupling sleeve 5, the connector has an external annular groove 23 for connecting the sheathed cable coupling to the mating connector (not shown in FIG. 1) by means of a U-shaped plug yoke, as is generally known. The mating connector, in a known manner, has contact elements corresponding to the contact elements 13, and is provided in the usual manner with two parallel tangential grooves into which a plug yoke can be inserted, clasping the annular groove 23 and thus establishing the pullproof connection of the sheathed cable coupling.

In the illustrated embodiment the connector 3 is also provided on its portion 5 with a further annular groove 24 which is located between the compression groove 7 and the annular groove 23 and which forms a withdrawal groove into which a tool can be inserted if it should become necessary to part the entire connector 3 from the sheath 2 at the compression joint e.g. in order to replace the sheath and/or the cable coupling.

Figure 2:
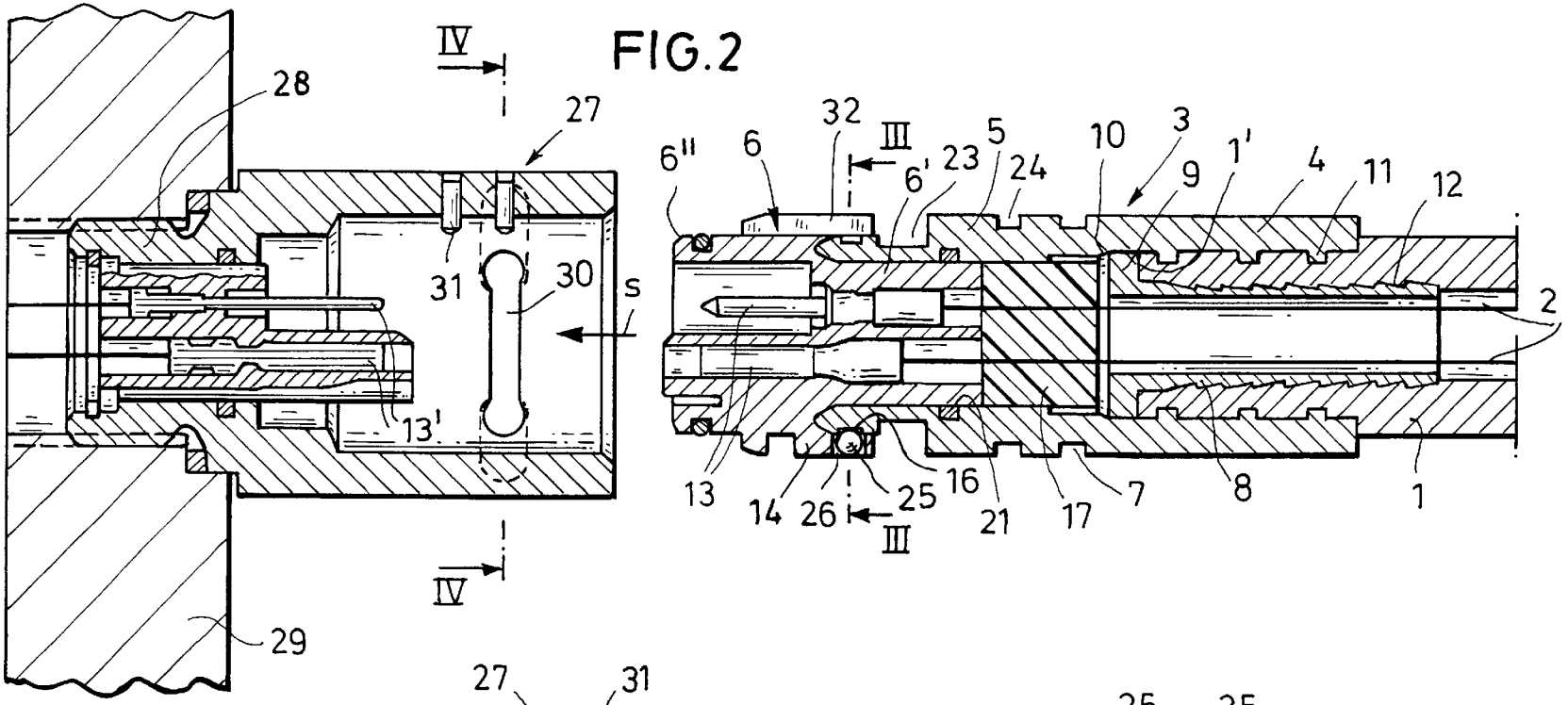
FIG. 2 shows, likewise in axial section, a modified embodiment of a plug coupling together with the mating connector; this differs from the embodiment in FIG. 1 chiefly in respect of the snap connection for the insert.
Figure 3:
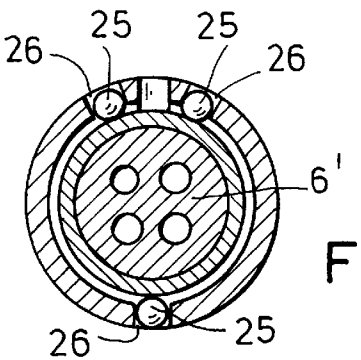
FIGS. 3 and 4 each show a cross-section, taken on the lines III—III and IV—IV, respectively, in FIG. 2.
Figure 4:
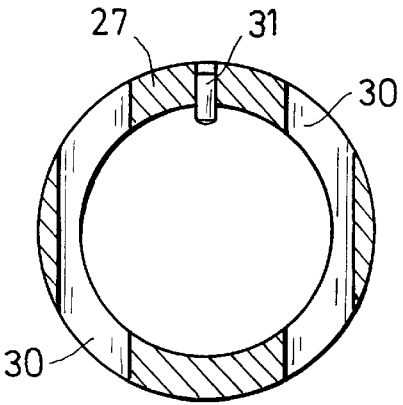

The plug-type electrical coupling illustrated in FIGS. 2 to 4 basically corresponds, apart from the configuration of the snap connection, to that in FIG. 1, and similar parts have been given the same reference numbers.

The snap connection shown in FIGS. 2 to 4 between the portion of the length of the connector 3 forming the coupling sleeve 5 and the insert 6 inserted into the coupling sleeve 5 employs as latching projections metal snap elements in the form of small snap balls 25, preferably made of stainless steel, three snap balls 25 being here provided, spaced apart from one another around the circumference of the coupling collar 14 (FIG. 3). The snap balls are held with a force or press fit in recesses 26 in the coupling collar 14 which are formed by radial bores or insertion holes through the coupling collar. Advantageously matters are arranged so that the insertion holes 26 have a smaller diameter or cross-section than the snap balls 25, so that they are elastically expanded when the snap balls 25 are forced into the insertion holes 26 from outside until, as illustrated, they partially project internally from the insertion holes, and are able to snap into the recess or into the groove 16 substituting therefor, at the tip of the coupling sleeve 5.

In one possible assembly procedure, after the stopper part 6' of the insert 6 has been inserted in the coupling sleeve 5, the snap balls 25 are pressed into the insertion holes 26 from outside so that they engage internally in the groove 16 thus locking the insert 6 in its specified position in the coupling sleeve 3. To release this snap connection when the need arises, tension is applied to the insert and/or connector so that the snap balls slip over the lateral edge of the groove or out of the plastic body or, as the case may be, are pulled out of the snap collar of the plastic insert.

The snap balls 25 used for the snap connection advantageously have a diameter of about 2 to 3 mm, while the insertion holes 26 may have a slightly smaller diameter. It will be seen that this configuration of snap connection also affords a reliable, positionally accurate locking of the insert 6 to the connector 3, by simple means.

FIGS. 2 to 4 also show one embodiment of a mating connector 27 for the plug-type coupling described above. Here the mating connector consists of a plug socket, open towards the plugging end of the connector 3, which is provided at its other end with an axial socket extension 28 of reduced diameter and provided with an external screw thread for connecting the plug socket 27 to a component 29, e.g. to the casing of a piece of electrical equipment or to a mounting plate or the like. The mating connector 27 contains the electrical contact elements 13' corresponding to the contact elements 13 of the connector 3. Here again the contact elements 13' consist of contact pins and/or contact sockets, a socket 13' in the mating connector 27 being assigned to each contact element of the connector 3 which consists of a contact pin, and a contact pin 13' in the mating connector 27 being assigned to each contact socket 13 in the connector 3.

To make the plug connection, the connector 3 is inserted in the direction of the arrow S into the mating connector 27 sufficiently to establish the electrical connections between the contact elements 13 and 13', whereupon the plug coupling is secured, in a manner known in itself, by means of a U-shaped plug yoke which is inserted, from outside, in tangential bores 30 (FIG. 4) of the mating connector 27, clasping the groove 23 on the connector 3 with its parallel yoke-arms.

As can also be seen from FIG. 2, the socket of the mating connector 27 has a positioning pin 31 projecting radially into the socket, and co-operating with an axial groove 32 on the plug part 3, so that when the plug is connected the contact elements 13 are exactly aligned with the contact elements 13', and are brought into contact with them. The axial groove 32 may be provided on the insert 6, or alternatively on the coupling sleeve 5.

The insert 6 formed as a plastic moulding, which can be mounted on the connector 3 and fixed thereto by the snap connection, permits easy assembly. Once the insert 6 has been mounted on the connector 3 by means of the snap connection, there is no need for it to be secured against rotation, since it is not possible for the conductors to be broken by a rotation of the insert 6 with respect to the connector. With the snap connection envisaged, the latching projection can also be located on the connector 3 and the corresponding groove on the ring collar 14.

In another possible embodiment, the ring collar 14 consists of a closed ring with no slits, with the latching projection 15 shown in FIG. 1 formed integrally on its interior; in this case, the snap projection 15 does not form a closed ring, but is made up of a number of arc segments, e.g. four arc segments each with a length of arc of approximately ninety degrees, which are arranged on the ring collar 14 so as to be springy in the radial direction, so that when the insert 6 is mounted on the connector 3 each projection is initially displaced elastically radially outwards, and then snaps into the groove 16 on the connector 3, when the insert reaches its connected position in the connector.

In yet another possible arrangement, the snap connection is provided in the internal bore of the portion 5 of the length of the connector 3 forming the coupling sleeve, e.g. by means of snap elements formed on the circumference of the stopper part 6', which elastically snap into grooves in the connector upon insertion of the insert 6.

In a further possible embodiment in respect of the snap connection, the snap collar 14 is formed by a separate ring-shaped snap element which can be mounted on the insert 6 (after the latter is inserted into the connector 3) from its free end, making snap engagement with the connector 3 in a stop position on the insert 6, securing the connection of the insert 6 to the connector 3. The important point regarding the envisaged connection between insert and connector is that this connection is made by a positive lock, without the use of screwed components.

A number of alternatives also exist regarding the nature of the stopper 17 of sealing compound. In one possible embodiment, the stopper 17 does not have a pullproof or rotationproof connection to the insert 6, or to the latter's stopper part 6'. In this case, matters can advantageously be arranged so that the contact elements 13 embedded in the insert 6 terminate at the end face of the stopper part 6' facing the stopper 17, while the stripped ends of the conductors embedded in the stopper 17 terminate at electrical contact elements at the end face of the stopper 17 facing the stopper part 6', so that the electrical connections between the conductors 2 and the contact elements 13 are made automatically by contact between these elements upon insertion of the insert 6 into the connector 3.

It goes without saying that a sheathed cable coupling of the kind described above can also be provided at the other end of the protective sheath 1. As is generally known, various designs are possible for the mating connectors to which the sheathed cable according to the invention is electrically connected in a pullproof manner. The mating connectors can also be mounted on connection plates, equipment housings or other electrical components, and also on hydraulic cylinders equipped with electrical sensors, e.g. pressure sensors, stroke measuring devices and the like.

The invention is not limited to the embodiments described above; indeed it can be modified in a variety of respects without overstepping the bounds of the invention.

What is claimed is:

1. A plug-type coupling for a sheathed electrical cable, said cable comprising at least one electrical conductor and a flexible protective sheath around said at least one conductor, said sheather having an end;

said plug-type coupling comprising:

a one-piece unitary connector, said connector comprising a pressed sleeve portion and a coupling sleeve portion;

a backing sleeve for engaging in said end of said sheath of said electrical cable;

said pressed sleeve portion of said connector surrounding said end of said flexible protection sheath with said backing sleeve engaged in said end, said sheath thereby being gripped between said pressed sleeve portion and said backing sleeve to form a pull-proof and sealed connection, between said sheath and said connector;

an insert engageable in said coupling sleeve portion of said connector, said insert comprising at least one contact element, said at least one electrical contact element being electrically connectable to said at least one conductor of said electrical cable; and snap connection means on said insert and said coupling sleeve portion axially locking said insert in said coupling sleeve portion;

said electrically conductors extending out of the sheath into the connector being embedded in a stopper having a conical end, and being formed of a sealing compound, said stopper being supported within the connector at the rear thereof facing the sheath, and said backing sleeve comprises a support collar having a conical surface corresponding to that of said stopper said support collar overlapping said end of sheath and sitting against said stopper.

2. A plug-type coupling according to claim 1, wherein said one-piece connector is formed of metal and has a circumferential compression groove between said pressed sleeve portion and said coupling sleeve portion.

3. A plug-type coupling according to claim 1 wherein said insert is a plastics moulding.

4. A plug-type coupling according to claim 1, wherein said electrical cable comprise a plurality of electrical conductors which are held together within said stopper by a cable tie which surrounds them, said cables being spread apart from said cable tie towards said insert.

5. A plug-type coupling according to claim 1, wherein said stopper is joined to said insert comprising said at least one electrical contact element.

6. A plug-type coupling according to claim 1 wherein said insert is made of a plastics material, and comprises:

a stopper part which fits a cylindrical bore of said coupling sleeve portion and in which said electrical contact element is embedded, a sleeve-form extension integrally joined to said stopper part, said extension projecting from said connector to surround said contact element, and a ring-shaped snap collar on said sleeve-form extension.

7. A plug-type coupling according to claim 6, comprising an O-ring seal forming a seal between said stopper part of said insert and said coupling sleeve portion of said connector.

8. A plug-type coupling according to claim 1 comprising an end face seal ring is provided between a tip portion of said coupling sleeve portion and a snap collar on said insert.

9. A plug-type coupling according to claim 1 wherein said pressed sleeve portion is provided with radial projections directed towards said sheath and said backing sleeve is provided on its outer circumference with serrated indentations or the like.

10. A plug-type coupling according to claim 1 wherein said connector has a smaller wall thickness in said pressed sleeve portion than in said coupling sleeve portion.

11. A plug-type coupling according to claim 1 wherein said connector is provided with a withdrawal groove on its outer circumference.

12. A plug-type coupling according to claim 1 wherein said connector comprises an annular groove on its outer circumference for plug yoke engagement.

13. A plug-type coupling according to claim 1 wherein said insert is connected to said connector by a coupling collar which clasps a free end of said connector externally to form said snap connection.

14. A plug-type coupling according to claim 13, wherein said connector comprises a snap groove around its outer circumference and said coupling collar comprises a corresponding rib-like latching projection on its interior.

15. A plug-type coupling according to claim 13 wherein said ring-shaped snap collar is provided with axial slits staggered in the circumferential direction.

16. A plug-type coupling according to claim 1 wherein snap connection means comprises snap elements in the form of co-operating latching projections and recesses provided on said insert and on said coupling sleeve portion, said the latching projections being formed by metal inserts.

17. A plug-type coupling according to claim 16, wherein said metal latching projections are held in recesses in said insert with a force or press fit.

18. A plug-type coupling according to claim 17, wherein said recesses are radial insertion holes arranged on a coupling collar of said insert, into which said metal latching projections are inserted from outside so as to engage internally in said recess on said connector.

19. A plug-type coupling according to claim 16, wherein a plurality of latching projections are provided, distributed at intervals around the circumference of said insert or of a coupling collar thereof.

20. A plug-type coupling according to claim 1, in combination with a mating connector, said mating connector comprising a plug socket for said at least one contact element and into which said coupling sleeve portion of said connector is axially insertable, said mating connector further comprising more or less tangential insertion openings for a plug yoke which secures the plugged coupling, and a radially inwards directed positioning guide which co-operates with an axial groove on the outer circumference of said connector.

* * * * *